US009714506B1

(12) United States Patent
Tang

(10) Patent No.: US 9,714,506 B1
(45) Date of Patent: Jul. 25, 2017

(54) TOILET

(71) Applicant: Yi-Wen Tang, Taichung (TW)

(72) Inventor: Yi-Wen Tang, Taichung (TW)

( * ) Notice: Subject to any disclaimer, the term of this patent is extended or adjusted under 35 U.S.C. 154(b) by 0 days.

(21) Appl. No.: 15/212,192

(22) Filed: Jul. 16, 2016

(51) Int. Cl.
*E03D 5/10* (2006.01)
*E03D 1/34* (2006.01)

(52) U.S. Cl.
CPC *E03D 5/10* (2013.01); *E03D 1/34* (2013.01)

(58) Field of Classification Search
CPC ..... E03D 5/10; E03D 1/34
USPC ..... 4/406
See application file for complete search history.

(56) References Cited

U.S. PATENT DOCUMENTS 8,418,277 B2 * 4/2013 Okubo ..... E03D 5/10 4/432

* cited by examiner

*Primary Examiner* — Tuan N Nguyen

(57) ABSTRACT

A toilet includes first and second flushing outlets, and first and second electro-magnetic valves. The operation time for the first and second electro-magnetic valves is controlled by the controller. Water is dispensed by the first and second electro-magnetic valves and flows to the first and second pipes to respectively flush the waste in the second and first rooms from the first and second flushing outlets.

12 Claims, 9 Drawing Sheets

TOILET

BACKGROUND OF THE INVENTION

1. Fields of the Invention

The present invention relates to a toilet, and more particularly, to a toilet with first and second flushing outlets, and first and second electro-magnetic valves, water is dispensed by the first and second electro-magnetic valves to flush the waste from the first and second flushing outlets.

2. Descriptions of Related Art

The conventional toilet does not have a water hank and tap water is used to directly flush the waste in the toilet. The conventional toilet comprises an electro-magnetic valve, a pipe and a flushing outlet. The pipe is connected with the tap water source and the electro-magnetic valve is connected to the pipe which communicates with the flushing outlet. The electro-magnetic valve controls the pipe to be opened or closed so as to flush the waste in the toilet.

There is only one electro-magnetic valve which controls the amount of water to flush, and the conventional toile has only one flushing outlet. The electro-magnetic valve is able to control the amount of water to flush. However, only one electro-magnetic valve and one flushing outlet cannot meet different requirements when in use.

The present invention intends to provide a toilet which has first and second flushing outlets, and first and second electro-magnetic valves. Water is selectively dispensed by the first and second electro-magnetic valves to flush the waste from the first and/or second flushing outlets.

SUMMARY OF THE INVENTION

In order to improve the problems of the conventional toilet caused by the single electro-magnetic valve and one flushing outlet, the present invention provides a toilet that comprises first and second flushing outlets, and first and second electro-magnetic valves. Water flows from the first and second electro-magnetic valves to flush the second room by the first flushing outlet, and to flush the first room by the second flushing outlet. The toilet of the present invention has high efficiency of flushing and saves water.

The operation time for the first and second electro-magnetic valves is controlled by the controller. Water is dispensed by the first and second electro-magnetic valves and flows to the first and second pipes to respectively flush the waste in the second and first rooms from the first and second flushing outlets.

Compared with the conventional toilet, the present invention has at least two electro-magnetic valves and at least two flushing outlets. The controller controls the operation time for each of the first and second electro-magnetic valves, and water is dispensed by the first and second electro-magnetic valves and flows to the first and second pipes to respectively flush the waste in the second and first rooms from the first and second flushing outlets. The flushing efficiency is increased.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
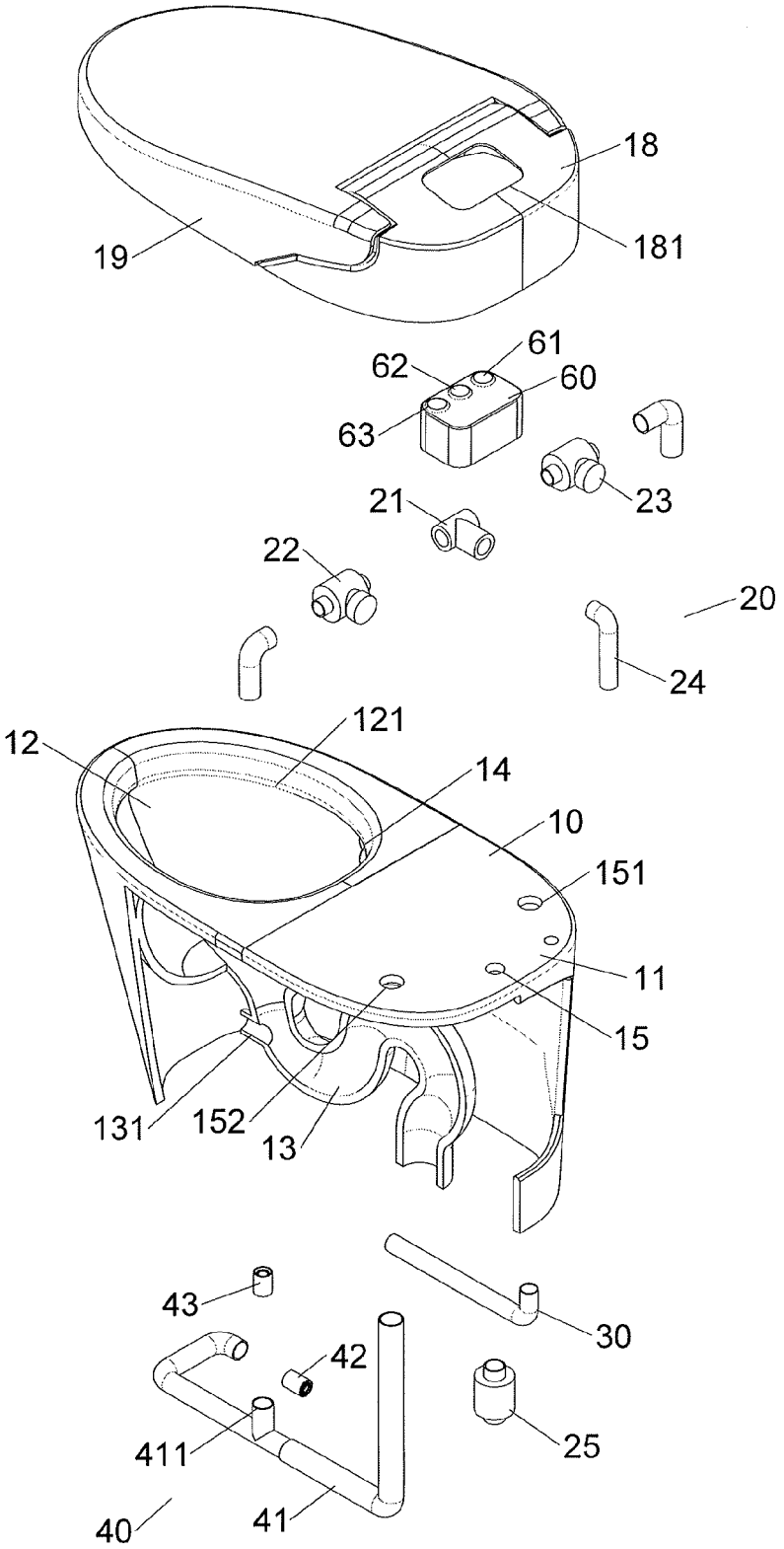
FIG. 1 is an exploded view of the toilet of the present invention.
Figure 2:
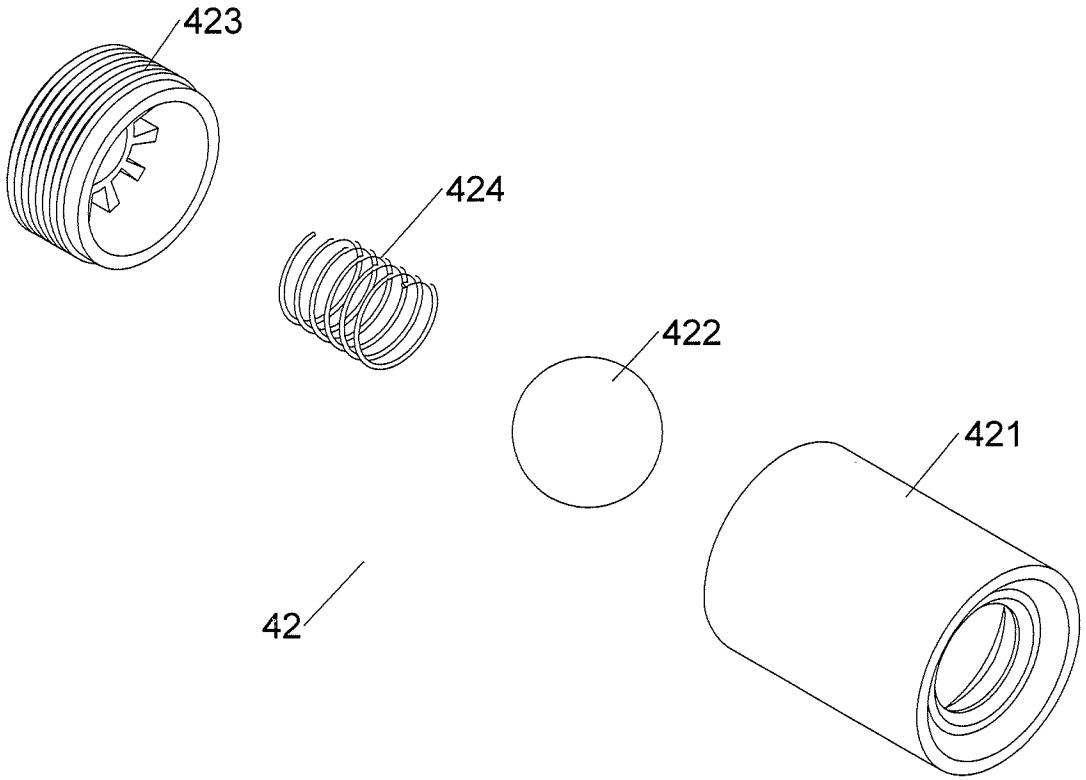
FIG. 2 is an exploded view of the first one-way valve unit of the toilet of the present invention.

Referring to FIGS. 1 and 2, the toilet of the present invention comprises a body 10 which has a space 11 defined therein, and further has a first room 12 and a second room 13. The first room 12 communicates with a first opening 121, and the second room 13 communicates with the first room 12 and having a first flushing outlet 131 which communicates with the second room 13. The second room 13 is a curved pipe. The first flushing outlet 131 is located close to a connection area between the first and second rooms 12, 13. The first flushing outlet 131 is used to flush the second room 13. The first room 12 has a second flushing outlet 14 which communicates with the first room 12. The second flushing outlet 14 is located close to the first opening 121 and is used to flush the first room 12. The space 11 includes a first aperture 15, a second aperture 151 and a third aperture 152. The first aperture 15 is connected between the second aperture 151 and the third aperture 152. The first, second and third apertures 15, 151, 152 each are a circular hole.

A base 18 is connected to the space 11 to seal the space 11. The base 18 has a hole 181 defined centrally therethrough in which the controller 60 is installed.

A lid 19 is pivotably connected to the base 18 so as to open or close the first opening 121 of the first room 12.

A control unit 20 is connected to the body 10 and includes a communication pipe 21, a first electro-magnetic valve 22, a second electro-magnetic valve 23, a water-supply pipe 24 and a pressure valve 25. The communication pipe 21 is located in the space 11 and is a three-way pipe which has a first tube, a second tube and a third tube. The first tube, the second tube and the third tube communicate with each other. The first electro-magnetic valve 22 is connected between the first tube of the communication pipe 21 and a first water pipe which extends through the third aperture 152. The second electro-magnetic valve 23 is connected between the second tube of the communication pipe 21 and a second water pipe which extends through the second aperture 151.

The water-supply pipe 24 communicates with the third tube of the communication pipe 21, and extends through the first aperture 15. The pressure valve 25 which has a first end thereof connected to the water-supply pipe 24, and a second end of the pressure valve 25 is connected to the tap water pipe. The control unit 20 is connected with the tap water pipe by the pressure valve 25 so that tap water flows from the water-supply pipe 24 to the communication pipe 21, the first electro-magnetic valve 22 and the second electro-magnetic valve 23.

A second pipe 30 is located in the body 10 and connected with the second flushing outlet 14 and the second water pipe of the second electro-magnetic valve 23. The second electro-magnetic valve 23 controls the tap water to flow from the second electro-magnetic valve 23 to the second pipe 30 and the second flushing outlet 14 to flush the first room 12.

A first pipe unit 40 is located in the body 10 and connected with the first flushing outlet 131 and the first water pipe of the first electro-magnetic valve 22. The first pipe unit 40 has a first pipe 41, a first one-way valve 42 and a second one-way valve 48. The first pipe 41 is connected between the first flushing outlet 131 and the first water pipe of the first electro-magnetic valve 22. The first pipe 41 has an installation unit 411 which is a circular hole. The first one-way valve 42, as shown in FIG. 2, is connected to one end of the first pipe 41 and seals the first flushing outlet 131 so that the tap water flows from the first pipe 41 to the first flushing outlet 131 and cannot flows back to the first pipe 41. The one-way valve unit 42 has a first one-way valve 421, a bead 422, a locking member 423 and a resilient member 424. The first one-way valve 421 is connected to the first pipe 41 and has a first open end and a second open end. The first open end communicates with an interior of the first pipe 41, and the second open end communicates with the first flushing outlet 131. The bead 422 is located in the first one-way valve 421 so as to seal the first open end of the first one-way valve 421. The locking member 423 is connected to the first one-way valve 421. The resilient member is located in the first one-way valve 421 and biased between the bead 422 and the locking member 423. When the bead 422 is pushed by tap water from the first pipe 41, the bead 422 moves toward the first one-way valve 421 and compresses the resilient member 424 so that the first open end of the first one-way valve 421 is opened, and the tap water flows from the first pipe 41 to the first flushing outlet 131 to flush the second room 13. The second one-way electro-magnetic valve 43 has the same structure as the first electro-magnetic valve 42. The first and second electro-magnetic valves 42, 43 are respectively connected to the installation unit 411 in opposite directions. The second electro-magnetic valve 43 introduces air into the first pipe 41 and the tap water in the first pipe 41 cannot flows out from the second electro-magnetic valve 43.

A controller 60 is located in the space 11 of the body 10 and is electrically connected to the first and second electro-magnetic valves 22, 23 by wires. The controller 50 is connected to the hole 181 of the base 18. The controller 60 has a first button 61, a second button 62 and a manual button 63. The controller 60 controls operation time of the first and second electro-magnetic valves 22, 23 by operation of the first and second buttons 61, 62. When the first button 61 is pushed, a first flushing time is applied. When the second button 62 is pushed, a second flushing time is applied which is shorter than that of the first flushing time. When no electric power is supplied and the manual button 63 is pushed, the first and second electro-magnetic valves 22, 23 are opened to flush. The controller 60 has a circuit board and a battery so as to provide power to the first and second electro-magnetic valves 22, 23.

Figure 3:
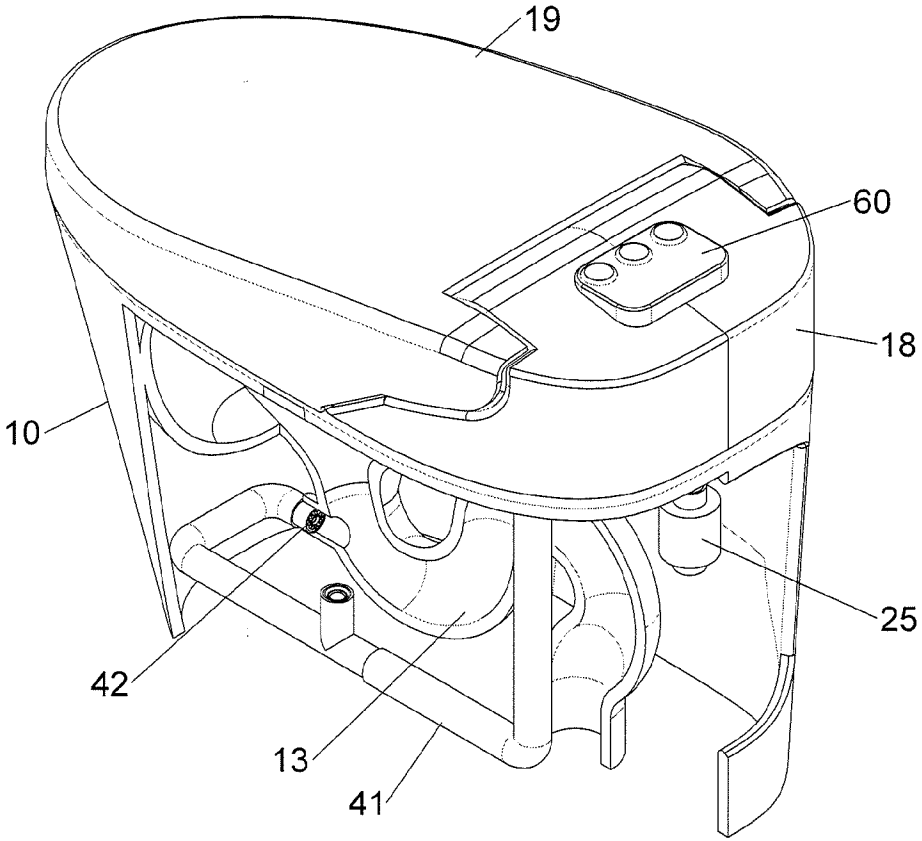
FIG. 3 is a perspective view to show the toilet of the present invention.

As shown in FIG. 3, the base 18 is connected to the space 11 and the lid 19 is pivotably connected to the base 18. The control unit 20 is connected to the body 10. The pressure valve 25 of the control unit 20 is connected to the tap water pipe. The controller 60 is connected to the hole 181.

Figure 4:
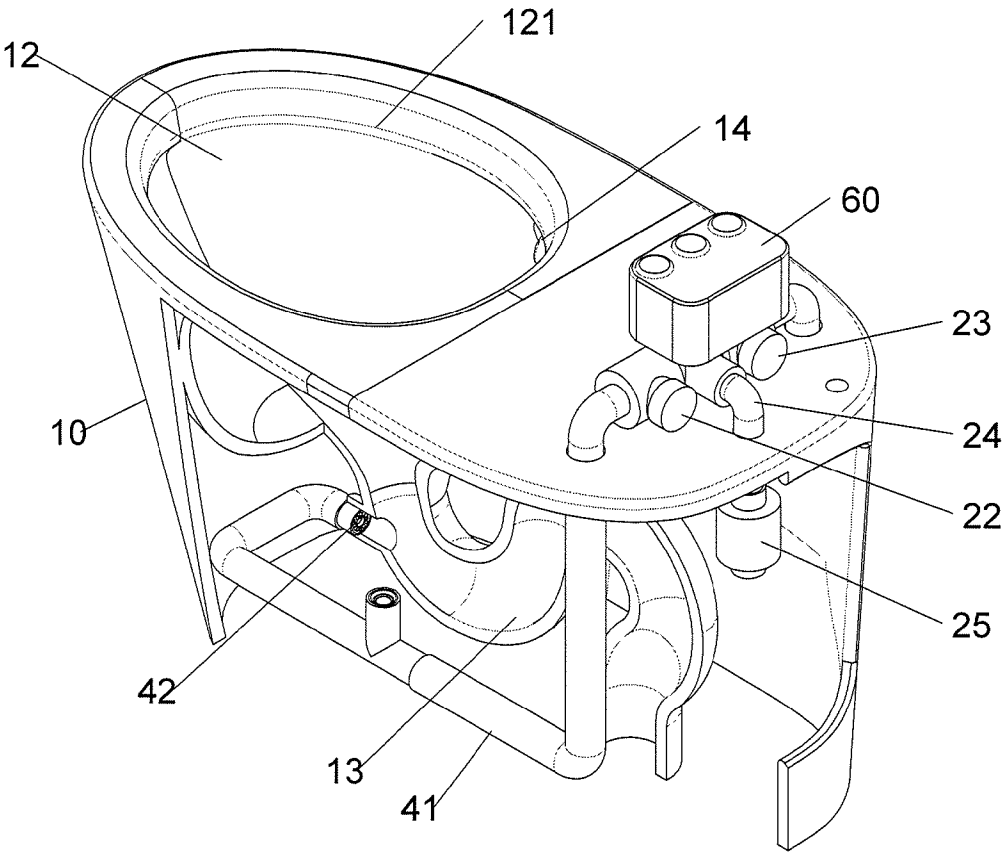
FIG. 4 is a perspective view to show a portion of the toilet of the present invention.
Figure 5:
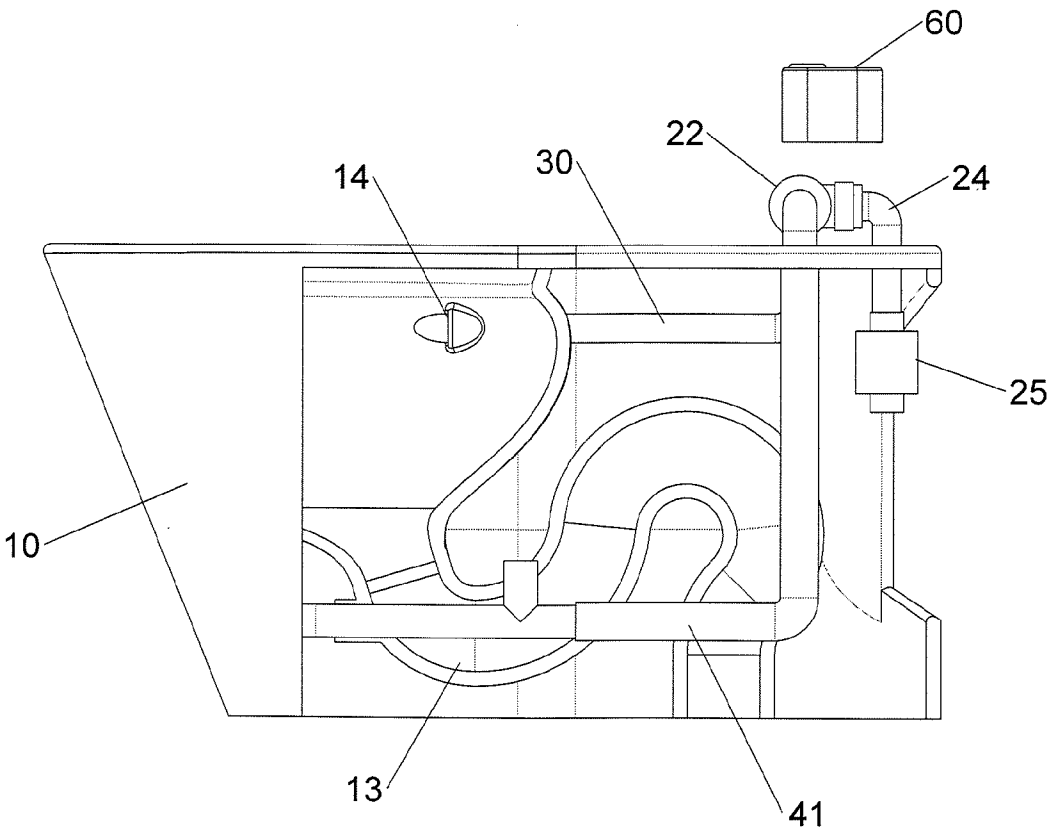
FIG. 5 is a side view of the toilet of the present invention.
Figure 6:
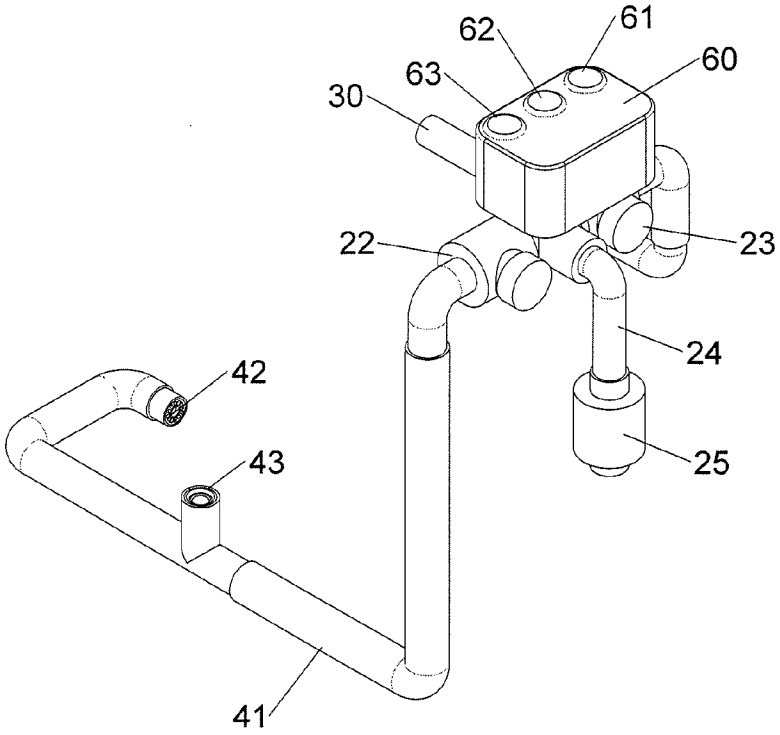
FIG. 6 shows the piping system of the toilet of the present invention.

As shown in FIGS. 4 to 6, the control unit 20 is connected to the body 10, and the second pipe 30 is connected to the second flushing outlet 14 and the second electro-magnetic valve 23. The first pipe unit 40 is connected to the first flushing outlet 131 and the first electro-magnetic valve 22. The controller 60 is electrically connected to the first and second electro-magnetic valves 22, 23. The controller 60 controls the operation time of the first and second electro-magnetic valves 22, 23. When any of the first button 61, the second button 62 and the manual button 63 is pushed, the controller 60 controls the first and second electro-magnetic valves 22, 23 to be operated in sequence or simultaneously. The tap water flows from the water-supply pipe 24 to the communication pipe 21 and to the first and second electro-magnetic valves 22, 23 respectively. The tap water can flows from the first electro-magnetic valve 22 to the first pipe 41 of the first pipe unit 40, and the tap water then flows from the first one-way valve 42 to the first flushing outlet 131 and flushes the second room 13. Alternatively, the tap water can flows from the second electro-magnetic valve 23 to the second pipe 30, and the tap water then flows from the second pipe 30 to the second flushing outlet 14 and flushes the first room 12.

Preferably, the second electro-magnetic valve 23 is first opened and the second flushing outlet 14 flushes the first room 12, and the second electro-magnetic valve 23 is then closed. The first electro-magnetic valve 22 is then opened and the first flushing outlet 131 flushes the second room 13, and the first electro-magnetic valve 22 is then closed. The second electro-magnetic valve 23 is re-opened again to supply water to first room 12 from the second flushing outlet 14. The second electro-magnetic valve 23 and the first electro-magnetic valve 22 are opened individually in sequence to prevent the first and second flushing outlet 14, 131 from flushing simultaneously to cause low water pressure.

Figure 7:
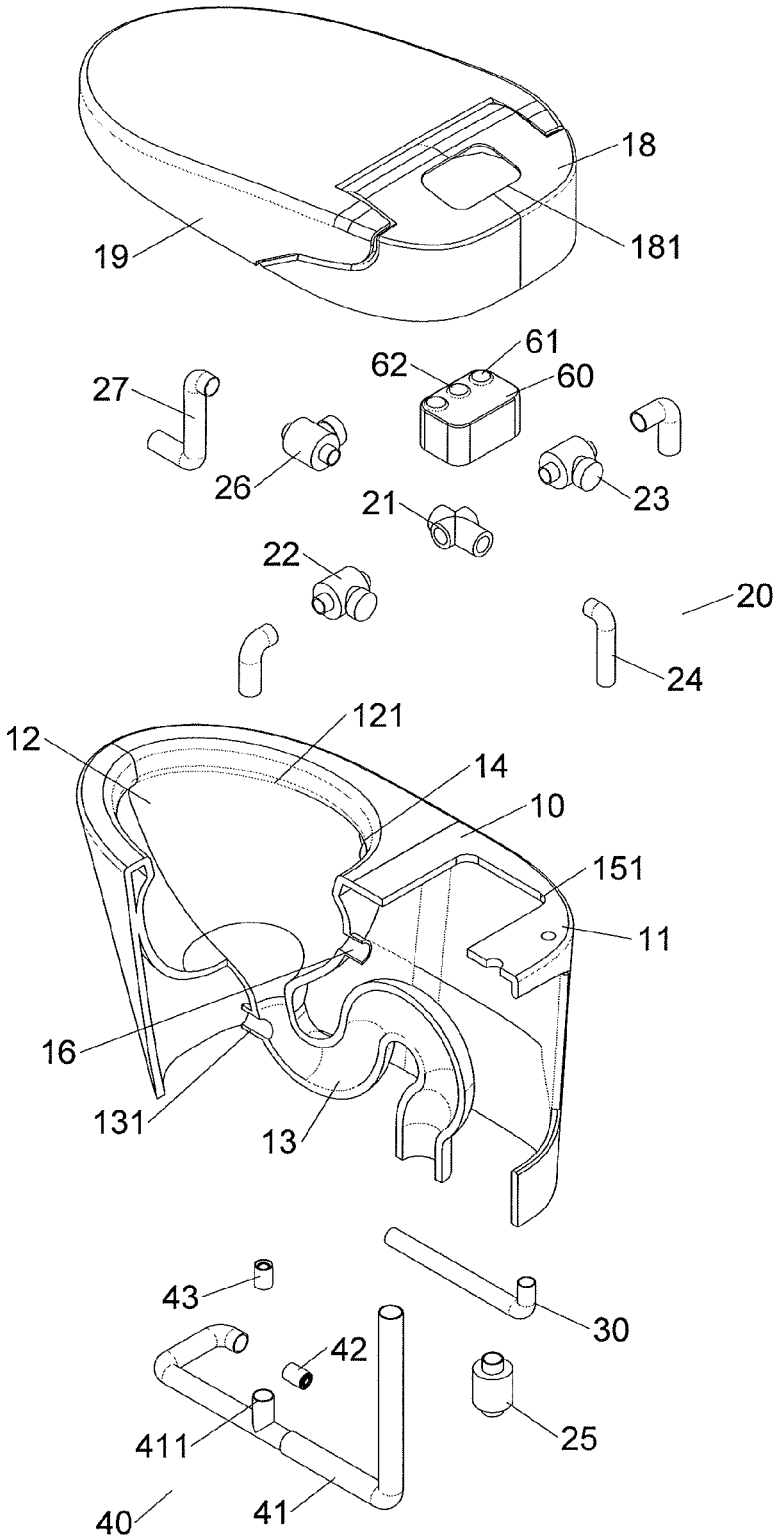
FIG. 7 is an exploded view of the second embodiment of the toilet of the present invention.
Figure 8:
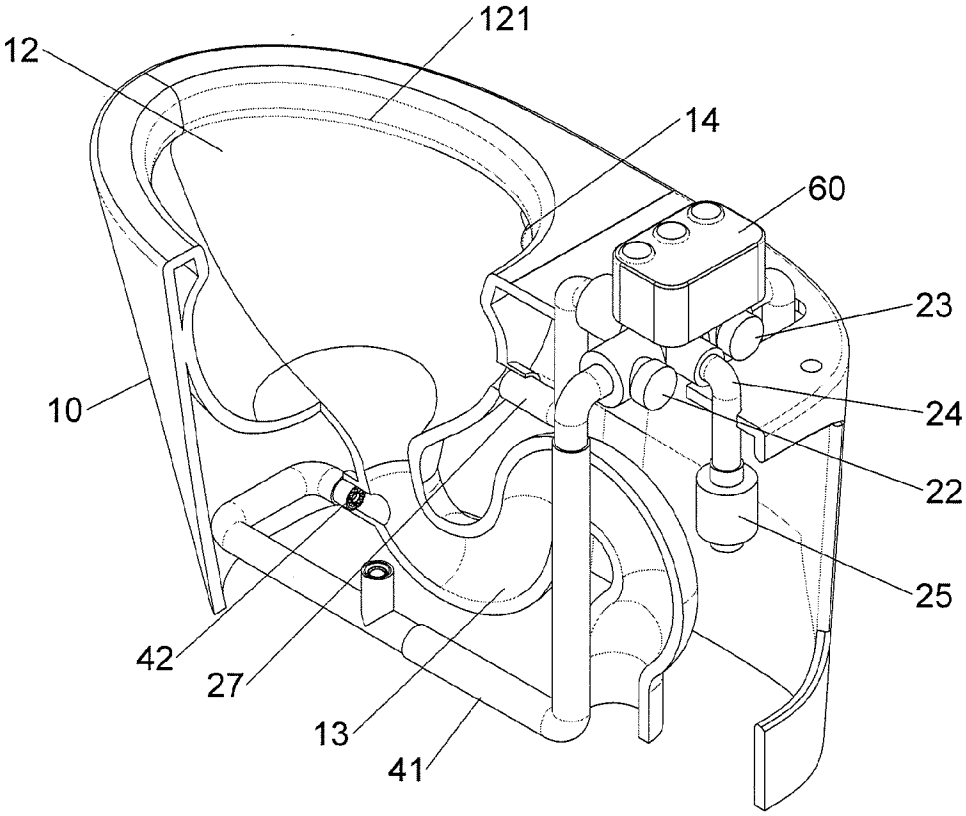
FIG. 8 is a perspective view to show a portion of the second embodiment of the toilet of the present invention.
Figure 9:
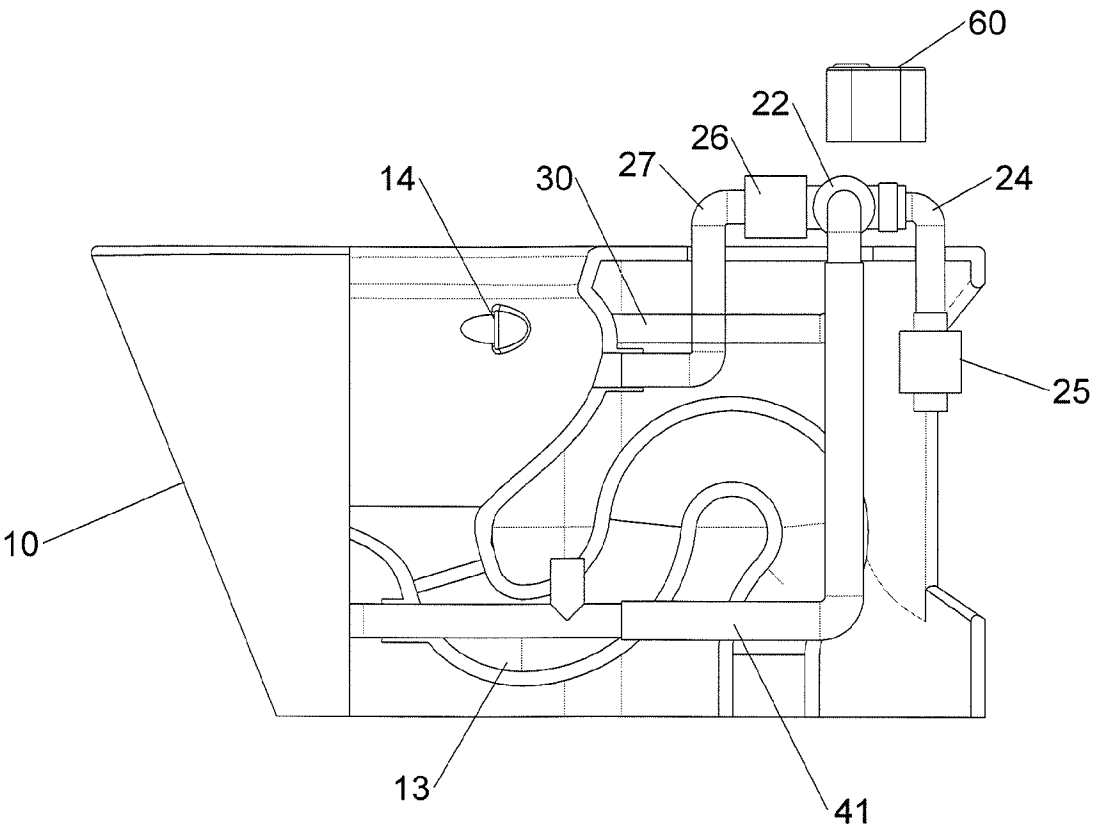
FIG. 9 is a side view of the second embodiment of the toilet of the present invention.

As shown in FIGS. 7 to 9, the body 10 has a third flushing outlet 16 which communicates with the first room 12 and flushes the first room 12. The height of the third flushing outlet 16 is lower than that of the second flushing outlet 14. The communication pipe 21 is a four-way pipe and has a fourth tube. A third electro-magnetic valve 26 is connected to the fourth tube of the communication pipe 21. A third pipe 27 is connected to the third flushing outlet 16 and the third electro-magnetic valve 26. The third electro-magnetic valve 26 controls the tap water to flow from the third electro-magnetic valve 26 to the third pipe 27 and to the third flushing outlet 16 to flush the first room 12.

In another embodiment, the control unit 20 does not have the pressure valve 25. The tap water pipe is directly connected to the water-supply pipe Yet another embodiment, the first pipe 41 of the first pipe unit 40 does not have the installation unit 411 and the second one-way electro-magnetic valve 43.

A further embodiment shows that the body 10 is not connected with a water tank, and the control unit 20 is directly connected to the tap water pipe. The control unit 20 is able to be connected with the water tank of the conventional toilet. The water tank is connected to a pressure valve 25 or the water-supply pipe 24.

The advantages of the present invention are that, the present invention has at least two electro-magnetic valves and at least two flushing outlets. The controller controls the operation time for each of the first and second electro-magnetic valves 22, 23, and water is dispensed by the first and second electro-magnetic valves 22, 23 and flows to the first and second pipes 41, 30 to respectively flush the waste in the second and first rooms 13, 12 from the first and second flushing outlets 131, 14. The flushing efficiency is increased.

The controller 60 controls the first and second electro-magnetic valves 22, 23 to open, the tap water enters into the communication pipe 21 via the pressure valve 25 and the water-supply pipe 24. The tap water then flows to the first and second electro-magnetic valves 22, 23 from the communication pipe 21. The tap water may flows from the first electro-magnetic valve 22, the first water pipe, the first pipe 41 of the first pipe unit 40, the first one-way valve 42 and to the first flushing outlet 131 which flushes the second room 13. Alternatively, The tap water may flows from the second electro-magnetic valve 23, the second water pipe, the second pipe 30, and the second flushing outlet 14 which flushes the first room 12.

Preferably, the second electro-magnetic valve 23 is first opened and the second flushing outlet 14 flushes the first room 12, and the second electro-magnetic valve 23 is then closed. The first electro-magnetic valve 22 is then opened and the first flushing outlet 131 flushes the second room 13, and the first electro-magnetic valve 22 is then closed. The second electro-magnetic valve 23 is re-opened again to supply water to first room 12 from the second flushing outlet 14.

The controller 60 has the first button 61 and the second button 62, the user may chooses any one of them to press. The difference between the operation of the first and second buttons 61, 62 is the flushing time so as to save water.

The first one-way valve 42 is connected to one end of the first pipe 41 and seals the first flushing outlet 131. When the bead 422 is pushed by the tap water in the first pipe 41, the bead moves toward the first one-way valve 421 and compresses the resilient member 424 so that the first open end of the first one-way valve 421 is opened. The tap water flows from the first pipe 41 to the first flushing outlet 131 to flush the second room 13. The first one-way electro-magnetic valve 42 prevents the tap water in the second room 13 from flowing back to the first pipe 41 to cause pipe clogging.

While we have shown and described the embodiment in accordance with the present invention, it should be clear to those skilled in the art that further embodiments may be made without departing from the scope of the present invention.

What is claimed is:

1. A toilet comprising:

a body having a space defined therein, the body including a first room and a second room, the first room communicating with a first opening, the second room communicating with the first room and having a first flushing outlet which communicates with the second room, the second room being a curved pipe, the first flushing outlet located close to a connection area between the first and second rooms, the first flushing outlet being used to flush the second room, the first room having a second flushing outlet which communicates with the first room, the second flushing outlet located close to the first opening and being used to flush the first room;

a control unit connected to the body and having a communication pipe, a first electro-magnetic valve, a second electro-magnetic valve and a water-supply pipe;

the communication pipe located in the space and being a three-way pipe, the communication pipe having a first tube, a second tube and a third tube, the first tube, the second tube and the third tube communicating with each other;

the first electro-magnetic valve being connected between the first tube of the communication pipe and a first water pipe;

the second electro-magnetic valve being connected between the second tube of the communication pipe and a second water pipe;

the water-supply pipe communicating with the third tube of the communication pipe;

the control unit adapted to be connected with a tap water pipe by the water-supply pipe so that tap water flows to the communication pipe, the first electro-magnetic valve and the second electro-magnetic valve;

a second pipe located in the body and connected with the second flushing outlet and the second water pipe of the second electro-magnetic valve, the second electro-magnetic valve controlling the tap water to flow from the second electro-magnetic valve to the second pipe and the second flushing outlet to flush the first room;

a first pipe unit located in the body and connected with the first flushing outlet and the first water pipe of the first electro-magnetic valve, the first pipe unit having a first pipe and a first one-way valve;

the first pipe connected between the first flushing outlet and the first water pipe of the first electro-magnetic valve;

the first one-way valve connected to one end of the first pipe and sealing the first flushing outlet so that the tap water flows from the first pipe to the first flushing outlet and cannot flows back to the first pipe, and a controller located in the space of the body and being electrically connected to the first and second electro-magnetic valves, the controller controlling operation time of the first and second electro-magnetic valves.

2. The toilet as claimed in claim 1, wherein the space includes a first aperture, a second aperture and a third aperture, the first aperture is connected between the second aperture and the third aperture, the first, second and third apertures each are a circular hole, the first water pipe of the first electro-magnetic valve extends through the third aperture, the second water pipe of the second electro-magnetic valve extends through the second aperture, the water-supply pipe extends through the first aperture.

3. The toilet as claimed in claim 1, wherein a base is connected to the space to seal the space, the base has a hole defined centrally therethrough in which the controller is installed.

4. The toilet as claimed in claim 3, wherein a lid is pivotably connected to the base so as to open or close the first opening of the first room.

5. The toilet as claimed in claim 1, wherein the control unit has a pressure valve which has a first end thereof connected to the water-supply pipe, a second end of the pressure valve is adapted to be connected to the tap water pipe, the control unit is adapted to be connected with the tap water pipe by the pressure valve so that tap water flows from the water-supply pipe to the communication pipe, the first electro-magnetic valve and the second electro-magnetic valve.

6. The toilet as claimed in claim 1, wherein the one-way valve unit has a first one-way valve, a bead, a locking member and a resilient member, the first one-way valve is connected to the first pipe and has a first open end and a second open end, the first open end communicates with an interior of the first pipe, the second open end communicates with the first flushing outlet, the bead is located in the first one-way valve so as to seal the first open end of the first one-way valve, the locking member is connected to the first one-way valve, the resilient member is located in the first one-way valve and biased between the bead and the locking member, when the bead is pushed by tap water from the first pipe, the bead moves toward the first one-way valve and compresses the resilient member so that the first open end of the first one-way valve is opened, the tap water flows from the first pipe to the first flushing outlet to flush the second room.

7. The toilet as claimed in claim 1, wherein the first pipe has an installation unit which is a circular hole, the first pipe has a second one-way electro-magnetic valve which has the same structure as the first electro-magnetic valve, the first and second electro-magnetic valves are respectively connected to the installation unit in opposite directions, the second electro-magnetic valve introduces air into the first pipe and the tap water in the first pipe cannot flows out from the second electro-magnetic valve.

8. The toilet as claimed in claim 1, wherein the controller has a first button, a second button and a manual button, the controller controls operation time of the first and second electro-magnetic valves by operation of the first and second buttons, when the first button is pushed, a first flushing time is applied, when the second button is pushed, a second flushing time is applied which is shorter than that of the first flushing time, when no electric power is supplied and the manual button is pushed, the first and second electro-magnetic valves are opened to flush.

9. The toilet as claimed in claim 1, wherein the second electro-magnetic valve is first opened and the second flushing outlet flushes the first room, and the second electro-magnetic valve is then closed, the first electro-magnetic valve is then opened and the first flushing outlet flushes the second room, and the first electro-magnetic valve is then closed, the second electro-magnetic valve is re-opened again to supply water to first room from the second flushing outlet, the second electro-magnetic valve and the first electro-magnetic valve are opened individually in sequence to prevent the first and second flushing outlet from flushing simultaneously to cause low water pressure.

10. The toilet as claimed in claim 1, wherein the body has a third flushing outlet which communicates with the first room and flushes the first room, a height of the third flushing outlet is lower than that of the second flushing outlet, the communication pipe is a four-way pipe and has a fourth tube, a third electro-magnetic valve is connected to the fourth tube of the communication pipe, a third pipe connected to the third flushing outlet and the third electro-magnetic valve, the third electro-magnetic valve controls the tap water to flow from the third electro-magnetic valve to the third pipe and to the third flushing outlet to flush the first room.

11. The toilet as claimed in claim 1, wherein the body is not connected with a water tank, the control unit is adapted to be directly connected to the tap water pipe.

12. The toilet as claimed in claim 1, wherein the body is connected to a water tank which is connected to a pressure valve or the water-supply pipe.

* * * * *